US009482972B2

(12) United States Patent
Ishizuka et al.

(10) Patent No.: US 9,482,972 B2
(45) Date of Patent: Nov. 1, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Daisuke Ishizuka, Kanagawa (JP); Yuki Takamiya, Kanagawa (JP); Yuka Kawamoto, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/632,218

(22) Filed: Feb. 26, 2015

(65) Prior Publication Data

US 2016/0041485 A1 Feb. 11, 2016

(30) Foreign Application Priority Data

Aug. 11, 2014 (JP) ..... 2014-163403

(51) Int. Cl.
*G03G 9/08* (2006.01)
*G03G 9/087* (2006.01)

(52) U.S. Cl.
CPC ..... *G03G 9/08711* (2013.01); *G03G 9/0825* (2013.01); *G03G 9/0827* (2013.01); *G03G 9/08795* (2013.01)

(58) Field of Classification Search
CPC ..... G03G 9/08711; G03G 9/08795
USPC ..... 430/109.3
See application file for complete search history.

(56) References Cited

U.S. PATENT DOCUMENTS 5,476,741 A 12/1995 Nishikiori et al.
6,495,648 B1 12/2002 Inagaki et al.

FOREIGN PATENT DOCUMENTS

JP H07-104515 4/1995
JP 2000-172010 A 6/2000
JP 2008-122560 A 5/2008

*Primary Examiner* — Mark A Chapman
(74) *Attorney, Agent, or Firm* — Oliff PLC

(57) ABSTRACT

An electrostatic charge image developing toner includes toner particles including a binder resin that contains a copolymer formed by copolymerizing at least an aromatic vinyl monomer and an aliphatic unsaturated alkyl carboxylate ester, wherein a weight ratio of component M1 of the aromatic vinyl monomer and component M2 of the aliphatic unsaturated alkyl carboxylate ester in the copolymer satisfies the following expression (1), and a weight ratio of volatile component m1 of the aromatic vinyl monomer and volatile component m2 of the aliphatic unsaturated alkyl carboxylate ester, as measured by a headspace method, satisfies the following expression (2):

$$0.10 \leq MW2/(MW1+MW2) \leq 0.30 \quad \text{Expression (1)}$$

$$0.70 \leq mw2/(mw1+mw2) \leq 0.98 \quad \text{Expression (2)}$$

wherein MW1 represents the weight of M1, MW2 represents the weight of M2, mw1 represents the weight of m1, and mw2 represents the weight of m2.

20 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2014-163403 filed Aug. 11, 2014.

BACKGROUND

1. Technical Field

The present invention relates to an electrostatic charge image developing toner, an electrostatic charge image developer, and a toner cartridge.

2. Related Art

Methods for visualizing image information via an electrostatic charge image by an electrophotographic method or the like are currently utilized in various fields. In the electrophotographic method, an electrostatic charge image formed on a photoreceptor by a charging step and an electrostatic charge image forming step is developed by using a developer including a toner; and the image is visualized through a transfer step; and a fixing step.

SUMMARY

According to an aspect of the invention, there is provided an electrostatic charge image developing toner, including toner particles including a binder resin that contains a copolymer formed by copolymerizing at least an aromatic vinyl monomer and an aliphatic unsaturated alkyl carboxylate ester, wherein a weight ratio of component M1 of the aromatic vinyl monomer and component M2 of the aliphatic unsaturated alkyl carboxylate ester in the copolymer satisfies the following expression (1), and a weight ratio of volatile component m1 of the aromatic vinyl monomer and volatile component m2 of the aliphatic unsaturated alkyl carboxylate ester, as measured by a headspace method, satisfies the following expression (2):

$$0.10 \leq MW2/(MW1+MW2) \leq 0.30 \quad \text{Expression (1)}$$

$$0.70 \leq mw2/(mw1+mw2) \leq 0.98 \quad \text{Expression (2)}$$

wherein in the expressions (1) and (2), MW1 represents the weight of M1, MW2 represents the weight of M2, mw1 represents the weight of m1, and mw2 represents the weight of m2.

BRIEF DESCRIPTION OF THE DRAWINGS

Exemplary embodiments of the present invention will be described in detail based on the following figures, wherein.

DETAILED DESCRIPTION

Figure 1:
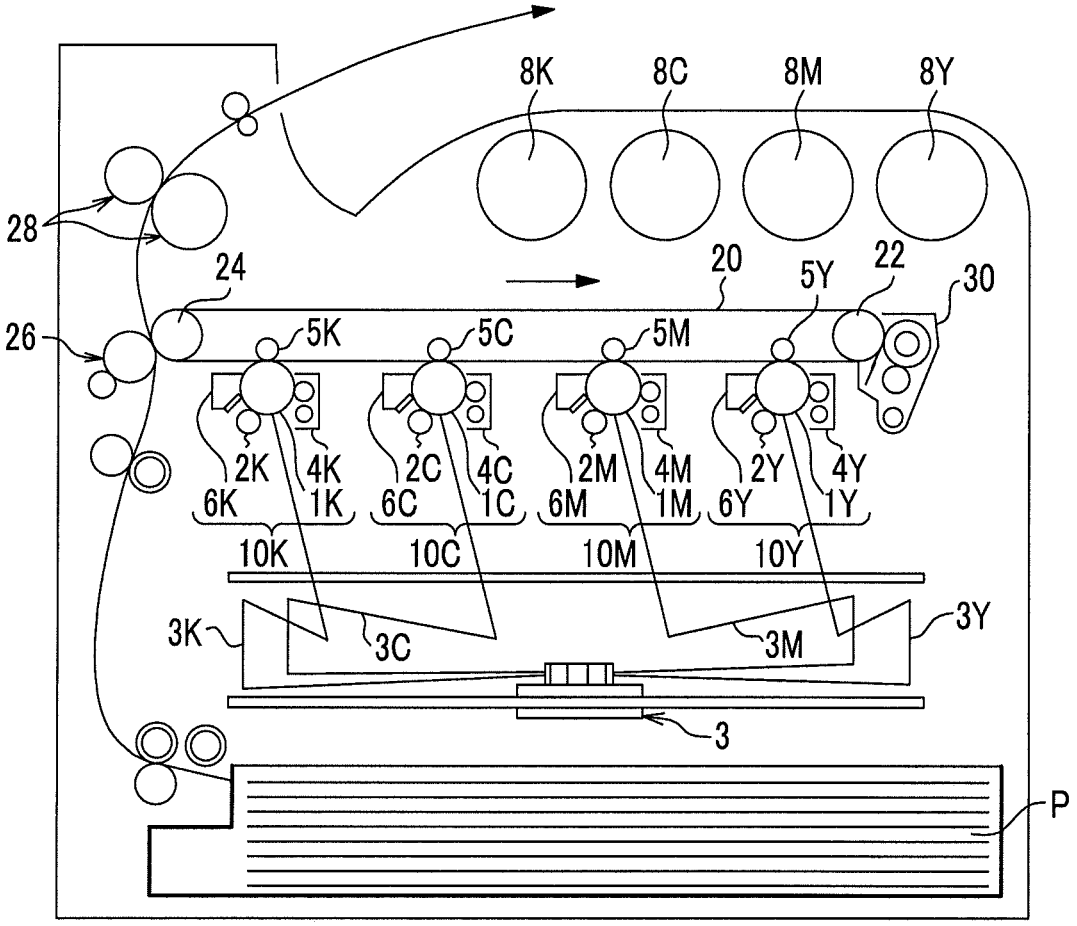
FIG. 1 is a schematic configuration diagram showing an example of an image forming apparatus according to the present exemplary embodiment.

Hereafter, the exemplary embodiment which is an example of the invention will be described in detail.

Electrostatic Charge Image Developing Toner

The electrostatic charge image developing toner according to the present exemplary embodiment (hereinafter referred to as a "toner" in some cases) contains a binder resin including a copolymer formed by copolymerizing at least an aromatic vinyl monomer and an aliphatic unsaturated alkyl carboxylate ester.

Furthermore, the weight ratio of the component M1 of the aromatic vinyl monomer and the component M2 of the aliphatic unsaturated alkyl carboxylate ester in the copolymer satisfies the following expression (1). Further, the weight ratio of the volatile component m1 of the aromatic vinyl monomer and the volatile component m2 of the aliphatic unsaturated alkyl carboxylate ester, as measured by a headspace method, satisfies the following expression (2).

$$0.10 \leq MW2/(MW1+MW2) \leq 0.30 \quad \text{Expression (1)}$$

$$0.70 \leq mw2/(mw1+mw2) \leq 0.98 \quad \text{Expression (2)}$$

In the expressions (1) and (2), MW1 represents the weight of M1, MW2 represents the weight of M2, mw1 represents the weight of m1, and mw2 represents the weight of m2.

Here, when a high-density image (for example, image density: 40%) is continuously output at a high speed (for example, using A4 paper as a recording medium at 100 sheets/min), paper staining such as black spots and band-shaped staining may occur in some cases under an environment of a low temperature, a temperature below zero or close to a freezing point, and a low humidity (for example, 4° C. and 8% RH). It is thought that this paper staining occurs by the phenomenon shown below.

When the electrostatic charge image developer (developer) is continuously stirred by the continuous output, the temperature in the developing unit (hereinafter also referred to as a "developing device") as well as the temperature of a toner in the developer in the developing device (hereinafter referred to as a "toner A" in some cases) are also raised. On the other hand, a toner freshly supplied to the developer in the developing device (hereinafter referred to as a "toner B" in some cases) has a lower temperature than that of the toner A, and therefore, when the toner B is supplied, the toners having different temperatures from each other in the developer, that is, the toner A and the toner B, are mixed. The low-temperature toner B has lower moisture-absorbing properties and a lower non-electrostatic adhesion force than the toner A, and therefore, it easily causes electrostatic aggregation and easily repels the toner A electrostatically. As a result, the toner B is not easily mixed with the toner A and a local increase in the toner concentration easily occurs. When the toner concentration is locally increased, the aggregated toner dripping or charging failure easily occurs and paper staining easily occurs.

Particularly, when the high-density image is continuously output, the toner B is supplied to the developer in a large amount, and therefore, paper staining more easily occurs.

Meanwhile, for the toner of the present exemplary embodiment, the weight ratio of the component M1 of the aromatic vinyl monomer and the component M2 of the aliphatic unsaturated alkyl carboxylate ester in the copolymer satisfies the range of the expression (1), and the weight ratio of the volatile component m1 of the aromatic vinyl monomer and the volatile component m2 of the aliphatic unsaturated alkyl carboxylate ester, as measured by a headspace method, satisfies the expression (2). Thus, the occurrence of the staining of paper when a high-density image is continuously output at a high speed under an environment of a low temperature, a temperature below zero or close to a freezing point, and a low humidity, is prevented.

The reason for this is not clear, but is presumed to be as follows.

First, the significance of the weight ratio of the component M2 of the aliphatic unsaturated alkyl carboxylate ester satisfying the range of the expression (1) will be described. The expression (1) means that the weight ratio of the component M2 of the aliphatic unsaturated alkyl carboxylate ester is controlled to be lower than the weight ratio of the component M1 of the aromatic vinyl monomer in the copolymer. The weight ratio of the component M2 in the copolymer tends to control the non-electrostatic adhesion force between the toners. Specifically, the aromatic vinyl monomer has properties that reduce the non-electrostatic adhesion force on the surface of the toner. On the other hand, the aliphatic unsaturated alkyl carboxylate ester has properties that increase the non-electrostatic adhesion force on the surface of the toner.

Accordingly, by setting the weight ratio of the component M2 to be lower than the weight ratio of the component M1, that is, by allowing the weight ratio of the component M2 to satisfy the expression (1), the non-electrostatic adhesion force of the toner itself is reduced, thereby obtaining the fluidity of the toner at a normal temperature (for example, 25° C.)

Next, the significance of the weight ratio of the volatile component m2 of the aliphatic unsaturated alkyl carboxylate ester satisfying the range of the expression (2) will be described. The expression (2) means that the weight ratio of the volatile component m2 of the aliphatic unsaturated alkyl carboxylate ester is controlled to be higher than the weight ratio of the volatile component m1 of the aromatic vinyl monomer in the toner. The weight ratio of the volatile component m2 in the toner tends to control the non-electrostatic adhesion force between the toners as described above. Specifically, the aliphatic unsaturated alkyl carboxylate ester has properties that increase the non-electrostatic adhesion force on the surface of the toner.

Accordingly, by setting the weight ratio of the volatile component m2 to be higher than the weight ratio of the volatile component m1, that is, by allowing the weight ratio of the volatile component m2 to satisfy the expression (2), a larger amount of the volatile component m2 actively precipitates on the surface of the toner when the temperature is raised (for example, to 45° C.). As a result, the non-electrostatic adhesion force between the toners increases.

It is thought that when a toner satisfying the expressions (1) and (2) is used, the following phenomenon occurs.

When the temperature of the developer in the developing device is raised (for example, to 45° C.) by the continuous output, the volatile component m2 in the toner easily precipitates on the surface of the toner A and is accumulated thereon. On the other hand, the toner B having a lower temperature than that of the toner A is in the state where the volatile component m2 hardly precipitates on the surface of the toner B.

The volatile component m2 which precipitates and is accumulated on the surface of the toner A is interposed between the toner A and the toner B (hereinafter referred to as "between the toners A/B" in some cases) to increase the non-electrostatic adhesion force between the toners A/B to be higher than the non-electrostatic adhesion force between the toners B. Further, by an increase in the non-electrostatic adhesion force between the toners A/B, the electrostatic aggregation of the toner B and the electrostatic repulsion to the toner A are easily prevented.

Thus, when the temperature of the developer is raised, the non-electrostatic adhesion force between the toners A/B is increased, and as a result, the toner A and the toner B are easily rapidly mixed even though the toner B having a lower temperature than that of the toner A is supplied to the existing toner A in the developing device.

From the above, when the toner of the present exemplary embodiment is applied to an image forming apparatus, even in the case where the temperature of the developer in the developing device is raised by the continuous output under an environment of a low temperature, a temperature below zero or close to a freezing point, and a low humidity, the mixing properties of the toner A and the toner B having different temperatures from each other is increased, and thus, the occurrence of the staining of paper when a high-density image is continuously output at a high speed is prevented.

Hereafter, the details of the toner according to the present exemplary embodiment will be described.

Toner

Specifically, the toner according to the present exemplary embodiment is configured to include toner particles, and if necessary, an external additive.

Toner Particles

The toner particles are configured to include a binder resin, and if necessary, a colorant, a release agent, and other additives. In an exemplary embodiment, a copolymer formed by copolymerizing at least an aromatic vinyl monomer and an aliphatic unsaturated alkyl carboxylate ester (hereinafter referred to as a "specific copolymer" in some cases) is used as the binder resin of the toner particles. For this reason, in the case where the "toner" is denoted below, it means a toner containing a specific copolymer.

Binder Resin

The binder resin contains the above-described specific copolymer. Further, the weight ratio of the component M1 of the aromatic vinyl monomer and the component M2 of the aliphatic unsaturated alkyl carboxylate ester in the specific copolymer satisfies the following expression (1).

Here, the component M1 of the aromatic vinyl monomer refers to a constitutional unit derived from the aromatic vinyl monomer included in the copolymer. The component M2 of the aliphatic unsaturated alkyl carboxylate ester refers to a constitutional unit derived from the aliphatic unsaturated alkyl carboxylate ester included in the copolymer.

$$0.10 \leq MW2/(MW1+MW2) \leq 0.30 \quad \text{Expression (1)}$$

In the expression (1), MW1 represents the weight of M1 and MW2 represents the weight of M2. The same shall apply hereinafter.

Furthermore, the weight ratio of the component M1 of the aromatic vinyl monomer and the component M2 of the aliphatic unsaturated alkyl carboxylate ester preferably satisfies the following expression (12), and more preferably the following expression (13).

$$0.12 \leq MW2/(MW1+MW2) \leq 0.29 \quad \text{Expression (12)}$$

$$0.14 \leq MW2/(MW1+MW2) \leq 0.28 \quad \text{Expression (13)}$$

By setting MW2/(MW1+MW2) to 0.10 or more, the non-electrostatic adhesion force of the toner particles themselves does not become too small at a low temperature, and image defects such as image deletion (for example, image whitening) are easily prevented. Further, by setting MW2/(MW1+MW2) to 0.30 or less, the non-electrostatic adhesion force of the toner particles themselves is obtained at a low temperature and the toner is easily mixed. Thus, paper staining is easily prevented.

Here, the weight ratio of the component M1 of the aromatic vinyl monomer and the component M2 of the aliphatic unsaturated alkyl carboxylate ester (MW2/(MW1+MW2)) in the expression (1) is determined by the following method, using a nuclear magnetic resonance (1H-NMR) device (JNM-AL400, manufactured by JEOL Ltd.).

In a 5-mm glass tube, a sample of the toner is dissolved in deuterated chloroform, measurement is carried out at a measurement temperature of 25° C., and the weight ratio (Mw2/(Mw1+Mw2)) is determined from the integrated value of each spectrum of the obtained components M1 and M2. Further, MW1 and MW2 may be quantified by creating a calibration curve, using a monomer standard product to be measured in advance. As an example, a description with respect to styrene will be given. A calibration curve is created with a resin obtained by mixing a known content of styrene with a resin which does not contain a styrene component, and compared to an intensity determined by the measurement, thereby determining the weight of each constituent unit in the resin.

The aromatic vinyl monomer will be described. The aromatic vinyl monomer is an aromatic compound having at least one vinyl group in the molecule.

Examples of the aromatic vinyl monomer include a styrene monomer; and other vinyl monomers such as vinyl benzoate and vinyl cinnamate. Among these, the styrene monomer is preferable.

Examples of the styrene monomer (monomer having a styrene skeleton) include styrene, α-methylstyrene, ethylstyrene, isobutylstyrene, tert-butylstyrene, bromostyrene, and chlorostyrene. Among these, from the viewpoints of controlling the non-electrostatic adhesion force of the toner particles, styrene is particularly preferable.

These aromatic vinyl monomers may be used alone or in combination of two or more kinds thereof.

The aliphatic unsaturated alkyl carboxylate ester will be described. Examples of the aliphatic unsaturated alkyl carboxylate ester include an ester compound of at least one selected from an aliphatic unsaturated monocarboxylic acid and an aliphatic unsaturated dicarboxylic acid with an aliphatic alcohol.

Examples of the aliphatic unsaturated monocarboxylic acid include (meth)acrylic acid, crotonic acid, isocrotonic acid, 3-butenoic acid, 4-pentenoic acid, 10-undecenoic acid, and oleic acid. Further, the (meth)acrylic acid means any one or both of an acrylic acid and a methacrylic acid.

Examples of the aliphatic unsaturated dicarboxylic acid include maleic acid, fumaric acid, itaconic acid, citraconic acid, and mesaconic acid.

Examples of the aliphatic alcohol include methanol, ethanol, 1-propanol (n-propyl alcohol), 2-propanol (isopropyl alcohol), 1-butanol (n-butyl alcohol), 2-methyl-1-propanol (isobutyl alcohol), 2-methyl-2-propanol (tert-butyl alcohol), 1-pentanol (n-amyl alcohol), 1-hexanol, 1-heptanol, 1-octanol (capryl alcohol), 2-ethylhexanol, 1-nonanol, 1-dodecanol (lauryl alcohol).

Among the aliphatic unsaturated alkyl carboxylate esters, the alkyl (meth)acrylate ester is preferable. Further, the alkyl group of the alkyl (meth)acrylate ester preferably has 2 to 6 carbon atoms from the viewpoints of controlling the non-electrostatic adhesion force of the toner particles. The alkyl group may be any of linear, branched, and cyclic, but from the viewpoints of controlling the non-electrostatic adhesion force of the toner particles, it is preferably linear. Further, examples of the alkyl group include an alkoxy group, a hydroxy group, a cyano group, and an alkyl group substituted with a halogen atom or the like.

Examples of the alkyl ester of the (meth)acrylic acid include methyl (meth)acrylate, ethyl (meth)acrylate, n-butyl (meth)acrylate, i-butyl (meth)acrylate, t-butyl (meth)acrylate, n-hexyl (meth)acrylate, 2-ethylhexyl (meth)acrylate, octyl (meth)acrylate, lauryl (meth)acrylate, and 2-methoxyethyl (meth)acrylate. Among these, n-butyl acrylate, n-hexyl acrylate, 2-ethylhexyl acrylate, and octyl acrylate are particularly preferable. Further, a commercially available product or a synthesized product may be used as the aliphatic unsaturated alkyl carboxylate ester. These aliphatic unsaturated alkyl carboxylate esters may be used alone or in combination of two or more kinds thereof.

Furthermore, the copolymer of the aromatic vinyl monomer and the aliphatic unsaturated alkyl carboxylate ester may contain additional component other than the aromatic vinyl monomer and the aliphatic unsaturated alkyl carboxylate ester. Examples of the additional component include nitrile monomers such as acrylonitrile and methacrylonitrile; unsaturated hydrocarbon monomers such as 1,3-butadiene; and crosslinking agents such as divinylbenzene, ethylene glycol dimethacrylate, provided that the proportion of the component M1 of the aromatic vinyl monomer and the component M2 of the aliphatic unsaturated alkyl carboxylate ester in the entire polymerization components is preferably 80% by weight or more (preferably 90% by weight or more).

The glass transition temperature (Tg) of the specific copolymer is preferably from 40° C. to 80° C., and more preferably from 45° C. to 75° C.

Further, the glass transition temperature is determined from a DSC curve obtained by differential scanning calorimetry (DSC), and more specifically, the glass transition temperature is determined from the "extrapolated glass transition onset temperature" described in the method of obtaining a glass transition temperature in the "Testing Methods for Transition Temperatures of Plastics" in JIS K-1987.

The weight-average molecular weight (Mw) of the specific copolymer is preferably from 5000 to 150000, and more preferably from 10000 to 100000.

The number-average molecular weight (Mn) of the specific copolymer is preferably from 2000 to 50000.

The molecular weight distribution Mw/Mn of the specific copolymer is preferably from 1.2 to 20, and more preferably from 1.5 to 15.

Further, the weight-average molecular weight and the number-average molecular weight are measured by gel permeation chromatography (GPC). The molecular weight measurement by GPC is performed using GPC manufactured by Tosoh Corporation HLC-8120 GPC as a measuring device, column manufactured by Tosoh Corporation TSK gel Super HM-M (15 cm), and a THF solvent. The weight-average molecular weight and the number-average molecular weight are calculated using a molecular weight calibration curve created from a monodisperse polystyrene standard sample from the results of the above measurement.

The method for preparing the specific copolymer is not particularly limited, and examples thereof include a preparation method including mixing aromatic vinyl monomers, aliphatic unsaturated alkyl carboxylate esters, a polymerization initiator, and an emulsifier, followed by performing emulsion polymerization.

The content of the specific copolymer is, for example, preferably from 15% by weight to 100% by weight, more preferably from 20% by weight to 100% by weight, and still more preferably from 25% by weight to 100% by weight, with respect to the entire binder resins.

The content of the binder resin is, for example, preferably from 40% by weight to 98% by weight, more preferably from 50% by weight to 97% by weight, and still more preferably from 60% by weight to 96% by weight, with respect to the entire toner particles.

The binder resin may contain a resin other than the specific copolymer. Examples of the resin other than the specific copolymer include known resins such as an epoxy resin, a polyester resin, a polyurethane resin, a cellulose resin, a polyether resin, a polyamide resin, and a modified rosin.

Colorant

Examples of the colorant include pigments such as carbon black, chrome yellow, Hansa yellow, benzidine yellow, thuren yellow, quinoline yellow, pigment yellow, permanent orange GTR, pyrazolone orange, Balkan orange, watchung red, permanent red, brilliant carmin 3B, brilliant carmin 6B, DuPont oil red, pyrazolone red, lithol red, Rhodamine B Lake, Lake Red C, pigment red, rose bengal, aniline blue, ultramarine blue, chalco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more kinds thereof.

If necessary, a surface-treated colorant may be used as the colorant, and the colorant may be used in combination with a dispersant. Further, a combination of plural kinds of the colorants may be used.

The content of the colorant is, for example, preferably from 1% by weight to 30% by weight, and more preferably from 3% by weight to 15% by weight, with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 150° C., and more preferably from 60° C. to 130° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-1987.

The content of the release agent is, for example, preferably from 1% by weight to 20% by weight, and more preferably from 3% by weight to 15% by weight, with respect to the entire toner particles.

Other Additives

Examples of other additives include known additives such as a magnetic material, a charge-controlling agent, and an inorganic powder. These additives are included as internal additives in the toner particles.

Characteristics or the Like of Toner Particles

In the present exemplary embodiment, the weight ratio of the volatile component volatilized from the toner particles, that is, the volatile component m1 of the aromatic vinyl monomer and the volatile component m2 of the aliphatic unsaturated alkyl carboxylate ester, as measured by a headspace method, satisfies the following expression (2).

Here, the volatile component m1 of the aromatic vinyl monomer refers to a component derived from unreacted aromatic vinyl monomers included in the toner particles, among the components volatilized from the toner particles by a headspace method. The volatile component m2 of the aliphatic unsaturated alkyl carboxylate ester refers to a component derived from the unreacted aliphatic unsaturated alkyl carboxylate esters included in the toner particles, among the components volatilized from the toner particles by a headspace method.

$$0.70 \leq mw2/(mw1+mw2) \leq 0.98 \quad \text{Expression (2)}$$

In the expression (2), mw1 represents the weight of m1 and mw2 represents the weight of m2. The same shall apply hereinafter.

Further, the weight ratio of the volatile component m1 of the aromatic vinyl monomer and the volatile component m2 of the aliphatic unsaturated alkyl carboxylate ester preferably satisfies the following expression (22), and more preferably the following expression (23).

$$0.75 \leq mw2/(mw1+mw2) \leq 0.97 \quad \text{Expression (22)}$$

$$0.80 \leq mw2/(mw1+mw2) \leq 0.96 \quad \text{Expression (23)}$$

By setting mw2/(mw1+mw2) to 0.70 or more, when the temperature of the developer in the developing device is raised, the volatile component m2 in the toner particles easily precipitates and is accumulated on the surface of the toner A (toner in the developer in the developing device), and thus, the non-electrostatic adhesion force between the toner A and the toner B (toner freshly supplied to the developer in the developing device) increases. Thus, the toner A and the toner B having different temperatures from each other are easily mixed. On the other hand, by setting mw2/(mw1+mw2) to 0.98 or less, excessive precipitation of the volatile component m2 on the surface of the toner A is easily prevented.

Here, the headspace method is an analysis method in which a sample is enclosed in a vial, heated at a constant temperature for a constant time, and then volatile components extracted in a gas phase are sucked, and then injected into gas chromatography (GC) to be separated, and detected.

The mw2/(mw1+mw2) in the expression (2) is determined by the measurement under the following conditions. Incidentally, mw1 and mw2 may be quantified by creating a calibration curve using a standard product of monomers to be measured in advance.

Gas chromatography device: manufactured by Shimadzu Corporation, (GC-2010)

Headspace sampler: manufactured by Perkinelmer Co., Ltd., (TurboMatrix HS40)

Headspace heating condition: heating at 130° C./3 min

Sample amount: 0.5 g

Carrier gas: nitrogen

Specifically, the amount of the volatile component m1 of the aromatic vinyl monomer is preferably from 2 ppm to 50 ppm, more preferably from 3 ppm to 40 ppm, and still more preferably from 4 ppm to 30 ppm. By setting the volatile component m1 to 2 ppm or more, image defects such as image deletion are easily prevented. Further, by setting the amount of the volatile component m1 to 50 ppm or less, toners having different temperatures from each other are easily mixed and thus, the paper staining is easily prevented.

The amount of the volatile component m2 of the unsaturated alkyl carboxylate ester is preferably from 25 ppm to 500 ppm, more preferably from 30 ppm to 450 ppm, and still more preferably from 40 ppm to 400 ppm. By setting the amount of the volatile component m2 to 25 ppm or more, toners having different temperatures from each other are easily mixed and thus, the paper staining is easily prevented. By setting the amount of the volatile component m2 to 500 ppm or less, image defects such as image deletion are easily prevented. Here, "ppm" is a ratio based on weight.

Further, the weight ratio (mw2/(mw1+mw2)) of the volatile component m1 of the aromatic vinyl monomer and the volatile component m2 of the aliphatic unsaturated alkyl carboxylate ester, the weight mw1 of the volatile component m1, and the weight mw2 of the volatile component m2 are controlled, using, for example, a difference in the reactivity between the aromatic vinyl monomer and the aliphatic unsaturated alkyl carboxylate ester. For example, in the case of preparing a specific copolymer by emulsion polymerization, the ratio may be controlled by a method of adding a polymerization initiator at the end of a polymerization reaction; a controlling method by changing polymerization temperatures; a method of adding an emulsion of an aliphatic unsaturated alkyl carboxylate ester at the end of a polymerization reaction to control the ratio of monomers; a method of further adding an aliphatic unsaturated alkyl carboxylate ester during the preparation of toner particles; or the like.

The toner particles may be toner particles having a single layer structure, or toner particles having a so-called core-shell structure composed of a core (core particle) and a coating layer (shell layer) that is coated on the core.

Here, the toner particles having a core-shell structure may preferably be composed of, for example, a core configured to include a binder resin, and if necessary, other additives such as a colorant and a release agent, and a coating layer configured to include a binder resin.

The volume average particle diameter (D50v) of the toner particles is preferably from 2 μm to 15 μm, and more preferably from 3 μm to 12 μm.

Moreover, various average particle diameters and various particle size distribution indices of the toner particles are measured using a Coulter Multisizer II (manufactured by Beckman Coulter, Inc.) with ISOTON-II (manufactured by Beckman Coulter, Inc.) as an electrolyte.

In the measurement, from 0.5 mg to 50 mg of a measurement sample is added to 2 ml of a 5% aqueous solution of a surfactant (preferably sodium alkylbenzene sulfonate) as a dispersant. The obtained material is added to from 100 ml to 150 ml of an electrolyte.

The electrolyte in which the sample is suspended is subjected to a dispersion treatment using an ultrasonic disperser for 1 minute, and a particle size distribution of particles having a particle diameter of from 2 μm to 60 μm is measured by a Coulter Multisizer II using an aperture having an aperture diameter of 100 μm. Further, 50000 particles are sampled.

Cumulative distributions by volume and by number are drawn from the small diameter side on the basis of particle size ranges (channels) separated, based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a cumulative number average particle diameter D50p. Further, the particle diameter when the cumulative percentage becomes 84% is defined as that corresponding to a volume particle diameter D84v and a number particle diameter D84p.

Using these, a volume average particle size distribution index (GSDv) is calculated as $(D84v/D16v)^{1/2}$ and a number average particle size distribution index (GSDp) is calculated as $(D84p/D16p)^{1/2}$.

A shape factor SF1 of the toner particles is preferably from 110 to 150, and more preferably from 120 to 145.

Furthermore, the shape factor SF1 is determined by the following equation:

$$\text{Equation: } SF1=(ML^2/A)\times(\pi/4)\times 100$$

In the equation, ML represents an absolute maximum length of a toner particle and A represents a projected area of a toner particle.

Specifically, the shape factor SF1 is digitalized by analyzing mainly a microscopic image or an image of a scanning electron microscope (SEM) using an image analyzer, and is calculated as follows. That is, an optical microscopic image of particles sprayed on the surface of a glass slide is captured into an image analyzer LUZEX through a video camera, the maximum lengths and the projected areas of 100 particles are obtained for calculation using the above-described equation, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

It is preferable that the surfaces of the inorganic particles as the external additive are subjected to a hydrophobization treatment. For example, the hydrophobization treatment is performed, by dipping the inorganic particles in a hydrophobizing agent. The hydrophobizing agent is not particularly limited and examples thereof include a silane coupling agent, silicone oil, a titanate coupling agent and an aluminum coupling agent. These may be used singly or in combination of two or more kinds thereof.

For example, the amount of the hydrophobizing agent is from 1 part by weight to 50 parts by weight with respect to 100 parts by weight of the inorganic particles.

Examples of the external additives also include resin particles (resin particles such as polystyrene, polymethyl methacrylate (PMMA), and a melamine resin) and cleaning aids (for example, a metal salt of higher fatty acid represented by zinc stearate and a particle of a fluorine polymer).

The amount of the external additive externally added is, for example, preferably from 0.01% by weight to 5% by weight, and more preferably from 0.01% by weight to 2.0% by weight, with respect to the toner particles.

Method of Preparing Toner

Next, a method for preparing the toner according to the present exemplary embodiment will be described.

The toner according to the present exemplary embodiment is obtained by preparing toner particles and then externally adding an external additive to the toner particles.

The toner particles may be prepared, by any of a dry method (for example, kneading and pulverizing method) and a wet method (for example, an aggregation and coalescence method, a suspension polymerization method, and a dissolution suspension method). The method of preparing the toner particles is not limited thereto and a known method may be employed. However, from the viewpoints of easiness in controlling the amounts of the volatile component m1 of the aromatic vinyl monomers and the volatile component m2 of the aliphatic unsaturated alkyl carboxylate ester, the toner particles are preferably prepared by an aggregation and coalescence method.

Specifically, for example, in the case where the toner particles are prepared using the aggregation and coalescence method, the toner particles are prepared through:

a step of preparing a resin particle dispersion in which resin particles which become a binder resin are dispersed (resin particle dispersion preparing step);

a step of forming aggregated particles by aggregating the resin particles (as necessary, other particles) in the resin particle dispersions (as necessary, in the dispersion after other particle dispersion is mixed) (aggregated particle forming step); and a step of forming toner particles by heating the aggregated particle dispersion in which the aggregated particles are dispersed to coalesce the aggregated particles (coalescence step).

Hereafter, the details of each of the steps will be described.

Further, while a method of obtaining toner particles containing a colorant and a release agent will be described in the following description, the colorant and the release agent are used, as necessary. Additional additives other than the colorant and the release agent may, of course, be used.

Resin Particle Dispersion Preparing Step

First, along with a resin particle dispersion in which resin particles which become a binder resin are dispersed, a colorant particle dispersion in which colorant particles are dispersed, and a release agent particle dispersion in which release agent particles are dispersed are prepared.

Here, the resin particle dispersion is prepared, for example, by dispersing resin particles in a dispersion medium by a surfactant.

An example of the dispersion medium used in the resin particle dispersion includes an aqueous medium.

Examples of the aqueous medium include water such as distilled water and ion exchange water, and alcohols and the like. These may be used singly or in combination of two or more kinds thereof.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, alkylphenol ethylene oxide adducts and polyols. Among these, particularly, anionic surfactants and cationic surfactants are preferable. The nonionic surfactants may be used in combination with anionic surfactants or cationic surfactants.

The surfactants may be used singly or in combination of two or more kinds thereof.

Examples of the method for dispersing the resin particles in a dispersion medium in the resin particle dispersion include ordinary dispersing methods, such as a method using a dispersion prepared according to an emulsion polymerization method by mixing monomers, a polymerization initiator, and an emulsifier, a method using a rotary shear type homogenizer, or a method using a ball mill, a sand mill, or a dyno mill having media. In addition, depending on the types of the resin particles, the resin particles may be dispersed in a resin particle dispersion, for example, by a phase inversion emulsification method.

Incidentally, the phase inversion emulsification method is a method in which a resin to be dispersed is dissolved in a hydrophobic organic solvent capable of dissolving the resin, a base is added to the organic continuous phase (O phase) for neutralization, an aqueous medium (W phase) is added to invert the resin into a discontinuous phase (so-caller inversed phase), from W/O to O/W, so that the resin may be dispersed in the form of particles in the aqueous medium.

The volume average particle diameter of the resin particles dispersed in the resin particle dispersions is preferably, for example, from 0.01 μm to 1 μM, more preferably from 0.08 μm to 0.8 μm, and even more preferably from 0.1 μM to 0.6 μm.

In addition, the volume average particle diameter of the resin particles is measured as follows: using the particle diameter distribution measured by a laser diffraction particle diameter distribution analyzer (for example, LA-700, manufactured by Horiba Seisakusho Co., Ltd.), a cumulative distribution is drawn from the small diameter side with respect to the volume based on the divided particle diameter ranges (channels) and the particle diameter at which the cumulative volume distribution reaches 50% of the total particle volume is defined as a volume average particle diameter D50v. Further, the volume average particle diameter of particles in the other dispersions will be measured in the same manner.

For example, the content of the resin particles contained in the resin particle dispersion is preferably from 5% by weight to 50% by weight, and more preferably from 10% by weight to 40% by weight.

Moreover, for example, the colorant particle dispersion, and the release agent particle dispersion are prepared in a manner similar to that for the resin particle dispersion. That is, with respect to the dispersion medium, the dispersion method, the volume average particle diameter of the particles, and the content of the particles in the resin particle dispersion, the same is applied to the colorant particles dispersed in the colorant particle dispersion and the release agent particles dispersed in the release agent particle dispersion.

Aggregated Particle Forming Step

Next, the resin particle dispersion is mixed with the colorant particle dispersion, and the release agent particle dispersion.

Further, in the mixed dispersion, the resin particles, the colorant particles, and the release agent particle are hetero-aggregated to form aggregated particles containing the resin particles, the colorant particles, and the release agent particles, which have a diameter close to a targeted particle diameter of the toner particles.

Specifically, for example, an aggregation agent is added to the mixed dispersion, and the pH of the mixed dispersion is adjusted to be acidic (for example, a pH ranging from 2 to 5). As necessary, a dispersion stabilizer is added thereto, followed by heating to the glass transition temperature of the resin particles (specifically, from the temperature 30° C. lower than the glass transition temperature of the resin particles to the temperature 10° C. lower than the glass transition temperature). The particles dispersed in the mixed dispersion are aggregated to form aggregated particles.

In the aggregated particle forming step, for example, the aggregation agent is added to the mixed dispersion while stirring using a rotary shear type homogenizer at room temperature (for example, 25° C.), and the pH of the mixed dispersion is adjusted to be acidic (for example, a pH ranging from 2 to 5). As necessary, a dispersion stabilizer may be added thereto, followed by heating.

Examples of the aggregation agent include a surfactant having a polarity opposite to the polarity of the surfactant used as the dispersant which is added to the mixed dispersion, an inorganic metal salt and a divalent or higher-valent metal complex. In particular, when a metal complex is used as an aggregation agent, the amount of the surfactant used is reduced, which results in improvement of charging properties.

An additive for forming a complex or a similar bond with a metal ion in the aggregation agent may be used, as necessary. As the additive, a chelating agent is suitably used.

Examples of the inorganic metal salt include metal salts such as calcium chloride, calcium nitrate, barium chloride, magnesium chloride, zinc chloride, aluminum chloride, and aluminum sulfate, and polymers of inorganic metal salts such as polyaluminum chloride, polyaluminum hydroxide and calcium polysulfide.

As the chelating agent, a water-soluble chelating agent may be used. Examples of the chelating agent include oxycarboxylic acids such as tartaric acid, citric acid and gluconic acid, iminodiacetic acid (IDA), nitrilotriacetic acid (NTA), and ethylenediamine tetraacetic acid (EDTA).

Coalescence Step

Next, the aggregated particles are coalesced by heating the aggregated particle dispersion in which the aggregated particles are dispersed up to, for example, the glass transition temperature of the resin particles or higher (for example, 10° C. to 30° C. higher than the glass transition temperature of the resin particles), thereby forming toner particles.

The toner particles are obtained by the above-described steps.

Further, the toner particles may also be prepared through a step in which after obtaining an aggregated particle dispersion in which the aggregated particles are dispersed, the aggregated particle dispersion is further mixed with a resin particle dispersion in which the resin particles are dispersed, and aggregation is performed to further adhere the resin particles onto the surface of the aggregated particles, thereby forming, second aggregated particles; and a step in which a second aggregated particle dispersion in which the second aggregated particles are dispersed is heated to coalesce the second aggregated particles, thereby forming toner particles having a core-shell structure.

Here, after completion of the coalescence step, the dried toner particles are obtained by subjecting the toner particles formed in the solution to a washing step, a solid-liquid separation step, and a drying step, as known in the art.

The washing step may be preferably sufficiently performed by a replacement washing with ion exchange water in terms of charging properties. The solid-liquid separation step is not particularly limited but may be preferably performed by filtration under suction or pressure in terms of productivity. The drying step is not particularly limited but may be preferably performed by freeze-drying, flash jet drying, fluidized drying or vibration fluidized drying in terms of productivity.

In addition, the toner according to the present exemplary embodiment is prepared by, for example, adding an external additive to the dried toner particles thus obtained, and mixing them. The mixing may preferably be performed with, for example, a V-blender, a Henschel mixer, a Loedige mixer, or the like. Further, if necessary, coarse particles of the toner may be removed using a vibrating sieving machine, a wind classifier, or the like.

Electrostatic Charge Image Developer

The electrostatic charge image developer according to the present exemplary embodiment is a developer including at least the toner according to the present exemplary embodiment.

The electrostatic charge image developer according to the present exemplary embodiment may be a single-component developer containing only the toner according to the present exemplary embodiment, or may be a two-component developer containing a mixture of the toner and a carrier.

There is no particular limitation to the carrier and examples of the carrier include known carriers. Examples of the carrier include a coated carrier in which the surface of a core made of magnetic particles is coated with a coating resin; a magnetic particle dispersed carrier in which magnetic particles are dispersed and blended in a matrix resin; and a resin impregnated carrier in which a porous magnetic particle is impregnated with a resin.

Incidentally, the magnetic particle dispersed carrier and the resin impregnated carrier may be carriers each having the constitutional particle of the carrier as a core and a coating resin coating the core.

Examples of the magnetic particle include magnetic metals such as iron, nickel, and cobalt; and magnetic oxides such as ferrite and magnetite.

Examples of the conductive particles include particles of metals such as gold, silver, and copper, and particles of carbon black, titanium oxide, zinc oxide, tin oxide, barium sulfate, aluminum borate, potassium titanate, or the like.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin containing an organosiloxane bond or a modified article thereof, a fluoro resin, polyesters, polycarbonates, a phenol resin, and an epoxy resin.

Further, the coating resin and the matrix resin may contain other additives such as a conductive material.

Here, in order to coat the surface of the core with the resin, a coating method using a coating layer forming solution in which a coating resin and various kinds of additives (used as necessary) are dissolved in an appropriate solvent may be used. The solvent is not particularly limited and may be selected depending on a coating resin to be used and application suitability.

Specific examples of the resin coating method include a dipping method of dipping a core in a coating layer forming solution, a spray method of spraying a coating layer forming solution to the surface of a core, a fluidized-bed method of spraying a coating layer forming solution to a core while the core is suspended by a fluidizing air, and a kneader coater method of mixing a core of a carrier with a coating layer forming solution in a kneader coater, and then removing the solvent.

In the two-component developer, a mixing ratio (weight ratio) of the toner and the carrier is preferably toner: carrier=1:100 to 30:100, and more preferably 3:100 to 20:100.

Image Forming Apparatus and Image Forming Method

An image forming apparatus and an image forming method according to the present exemplary embodiment will be described.

The image forming apparatus according to the present exemplary embodiment includes an image holding member; a charging unit that charges a surface of the image holding member; an electrostatic charge image forming unit that forms an electrostatic charge image on the surface of the charged image holding member; a developing unit that accommodates an electrostatic charge image developer, and develops the electrostatic charge image formed on the surface of the image holding member as a toner image using the electrostatic charge image developer; a transfer unit that transfers the toner image formed on the surface of the image holding member onto a surface of a recording medium; and a fixing unit that fixes the toner image transferred onto the surface of the recording medium. Further, as the electrostatic charge image developer, the electrostatic charge image developer according to the present exemplary embodiment is applied.

In the image forming apparatus according to the present exemplary embodiment, an image forming method (an image forming method according to the present exemplary embodiment) including a charging step of charging a surface of an image holding member; an electrostatic charge image forming step of forming an electrostatic charge image on the surface of the charged image holding member; a developing step of developing the electrostatic charge image formed on the surface of the image holding member as a toner image using the electrostatic charge image developer according to the present exemplary embodiment; a transfer step of transferring the toner image formed on the surface of the image holding member onto a surface of a recording medium; and a fixing step of fixing the toner image transferred onto the surface of the recording medium is carried out.

As the image forming apparatus according to the present exemplary embodiment, known image forming apparatuses such as a direct transfer type image forming apparatus which directly transfers a toner image formed on a surface of an image holding member onto a recording medium; an intermediate transfer type image forming apparatus which primarily transfers a toner image formed on a surface of an image holding member onto a surface of an intermediate transfer member and secondarily transfers the toner image transferred on the surface of the intermediate transfer member onto a surface of a recording medium; an image forming apparatus including a cleaning unit which cleans a surface of an image holding member after a toner image is transferred and before charging; and an image forming apparatus including an erasing unit which erases a surface of an image holding member after a toner image is transferred and before charging by irradiating the surface with easing light is applied.

In the case of the intermediate transfer type apparatus, for example, a configuration in which a transfer unit includes an intermediate transfer member to the surface of which a toner image is transferred, a primary transfer unit which primarily transfers the toner image formed on the surface of the image holding member onto the surface of the intermediate transfer member, and a secondary transfer unit which secondarily transfers the toner image transferred onto the surface of the intermediate transfer member onto the surface of the recording medium is applied.

In the image forming apparatus according to the present exemplary embodiment, for example, a portion including the developing unit may have a cartridge structure (process cartridge) which is detachable from the image forming apparatus. As the process cartridge, for example, a process cartridge provided with a developing unit which accommodates the electrostatic charge image developer according to the present exemplary embodiment is suitably used.

Hereafter, an example of the image forming apparatus according to the present exemplary embodiment will be described, but the invention is not limited thereto. Further, main components shown in the drawing will be described, and the descriptions of the other components will be omitted.

FIG. 1 is a schematic configuration diagram showing an image forming apparatus according to the present exemplary embodiment.

The image forming apparatus shown in FIG. 1 includes first to fourth electrophotographic image forming units 10Y, 10M, 10C, and 10K which output images of the respective colors including yellow (Y), magenta (M), cyan (C), and black (K) on the basis of color-separated image data. These image forming units (hereinafter, also referred to simply as "units" in some cases) 10Y, 10M, 100, and 10K are arranged horizontally with predetermined distances therebetween. These units 10Y, 10M, 100, and 10K may be each a process cartridge which is detachable from the image forming apparatus.

An intermediate transfer belt 20 is provided through each unit as an intermediate transfer member extending above each of the units 10Y, 10M, 100, and 10K in the drawing. The intermediate transfer belt 20 is wound around a drive roller 22 and a support roller 24 contacting the inner surface of the intermediate transfer belt 20, which are provided to be separated from each other from left to right in the drawing. The intermediate transfer belt 20 travels in a direction from the first unit 10Y to the fourth unit 10K. Incidentally, the support roller 24 is pushed in a direction moving away from the drive roller 22 by a spring or the like which is not shown, such that tension is applied to the intermediate transfer belt 20 which is wound around the support roller 24 and the drive roller 22. Further, on the surface of the image holding member side of the intermediate transfer belt 20, an intermediate transfer member cleaning device 30 is provided opposing the drive roller 22.

In addition, toners in the four colors of yellow, magenta, cyan and black, which are accommodated in toner cartridges 8Y, 8M, 8C, and 8K, respectively, are supplied to developing devices (developing units) 4Y, 4M, 4C, and 4K of the units 10Y, 10M, 10C, and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. Further, the same parts as in the first unit 10Y will be denoted by the reference numerals with magenta (M), cyan (C), and black (K) added instead of yellow (Y), and descriptions of the second to fourth units 10M, 100, and 10K will be omitted.

The first unit 10Y includes a photoreceptor 1Y functioning as the image holding member. In the surroundings of the photoreceptor 1Y, there are successively disposed a charging roller (an example of the charging unit) 2Y for charging the surface of the photoreceptor 1Y to a predetermined potential; an exposure device (an example of the electrostatic charge image forming unit) 3 for exposing the charged surface with a laser beam 3Y on the basis of a color-separated image signal to form an electrostatic charge image; the developing device (an example of the developing unit) 4Y for supplying a charged toner into the electrostatic charge image to develop the electrostatic charge image; a primary transfer roller (an example of the primary transfer unit) 5Y for transferring the developed toner image onto the intermediate transfer belt 20; and a photoreceptor cleaning device (an example of the cleaning unit) 6Y for removing the toner remaining on the surface of the photoreceptor 1Y after the primary transfer.

Further, the primary transfer roller 5Y is disposed inside the intermediate transfer belt 20 and provided in the position facing the photoreceptor 1Y. Further, bias power supplies (not shown), which apply primary transfer biases, are respectively connected to the respective primary transfer rollers 5Y, 5M, 5C, and 5K. A controller (not shown)

controls the respective bias power supplies to change the transfer biases which are applied to the respective primary transfer rollers.

Hereafter, the operation of forming a yellow image in the first unit 10Y will be described.

First, before the operation, the surface of the photoreceptor 1Y is charged by the charging roller 2Y.

The photoreceptor 1Y is formed by stacking a photosensitive layer on a conductive substrate (volume resistivity at 20° C.: $1\times10^{-6}$ Ωcm or lower). In general, this photosensitive layer has high resistance (resistance similar to that of general resin), and has properties in which, when irradiated with the laser beam 3Y, the specific resistance of a portion irradiated with the laser beam changes. Therefore, the laser beam 3Y is output to the charged surface of the photoreceptor 1Y through the exposure device 3 in accordance with yellow image data sent from the controller not shown. The photosensitive layer on the surface of the photoreceptor 1Y is irradiated with the laser beam 3Y, and as a result, an electrostatic charge image having a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charge flows on the surface of the photoreceptor 1Y and, in contrast, the charge remains in a portion which is not irradiated with the laser beam 3Y.

The electrostatic charge image which is thus formed on the photoreceptor 1Y is rotated to a predetermined development position along with the travel of the photoreceptor 1Y. At this development position, the electrostatic charge image on the photoreceptor 1Y is developed and visualized as a toner image by the developing device 4Y.

The developing device 4Y accommodates, for example, the electrostatic charge image developer, which contains at least a yellow toner and a carrier. The yellow toner is frictionally charged by being stirred in the developing device 4Y to have a charge with the same polarity as that of a charge on the photoreceptor 1Y and is maintained on a developer roller (as an example of the developer holding member). When the surface of the photoreceptor 1Y passes through the developing device 4Y, the yellow toner is electrostatically attached to a latent image portion which has been erased on the surface of the photoreceptor 1Y, and the latent image is developed with the yellow toner. The photoreceptor 1Y on which a yellow toner image is formed continuously travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has a polarity opposite to the polarity of the toner.

Meanwhile, the toner remaining on the photoreceptor 1Y is removed and collected by the photoreceptor cleaning device 6Y.

Also, primary transfer biases to be applied respectively to the primary transfer rollers 5M, 5C, and 5K of the second unit 10M and subsequent units, are controlled similarly to the primary transfer bias of the first unit.

In this manner, the intermediate transfer belt 20 having a yellow toner image transferred thereonto in the first unit 10Y is sequentially transported through the second to fourth units 10M, 10C, and 10K, and toner images of respective colors are superimposed and multi-transferred.

The intermediate transfer belt 20 having the four-color toner images multi-transferred thereonto through the first to fourth units arrives at a secondary transfer portion which is configured with the intermediate transfer belt 20, the support roller 24 coming into contact with the inner surface of the intermediate transfer belt and a secondary transfer roller 26 (an example of the secondary transfer unit) disposed on the side of the image holding surface of the intermediate transfer belt 20. Meanwhile, a recording sheet P (an example of the recording medium) is supplied to a gap at which the secondary transfer roller 26 and the intermediate transfer belt 20 are brought into contact with each other at a predetermined timing through a supply mechanism and a secondary transfer bias is applied to the support roller 24. The transfer bias applied at this time has the same polarity as the polarity of the toner, and an electrostatic force directing from the intermediate transfer belt 20 toward the recording sheet P acts upon the toner image, whereby the toner image on the intermediate transfer belt 20 is transferred onto the recording sheet P. Incidentally, on this occasion, the secondary transfer bias is determined depending upon a resistance detected by a resistance detecting unit (not shown) for detecting a resistance of the secondary transfer portion, and the voltage is controlled.

Thereafter, the recording sheet P is sent to a press contact portion (nip portion) of a pair of fixing rollers in a fixing device 28 (an example of the fixing unit), and the toner image is fixed onto the recording sheet P to form a fixed image.

Examples of the recording sheet P onto which the toner image is transferred include plain paper used for electrophotographic copying machines, printers and the like. As the recording medium, other than the recording sheet P, OHP sheets may be used.

The recording sheet P in which fixing of a color image is completed is discharged to an ejection portion, whereby a series of the color image formation operations ends.

Process Cartridge and Toner Cartridge

A process cartridge according to the present exemplary embodiment will be described.

The process cartridge according to the present exemplary embodiment is a process cartridge which includes a developing unit, which accommodates the electrostatic charge image developer according to the present exemplary embodiment and develops an electrostatic charge image formed on an image holding member as a toner image using the electrostatic charge image developer, and is detachable from an image forming apparatus.

Moreover, the configuration of the process cartridge according to the present exemplary embodiment is not limited thereto and may include a developing device and, additionally, at least one selected from other units such as an image holding member, a charging unit, an electrostatic charge image forming unit, and a transfer unit, as necessary.

Hereafter, an example of the process cartridge according to the present exemplary embodiment will be shown and the process cartridge is not limited, thereto. Main components shown in the drawing will be described, and the descriptions of the other components will be omitted.

Figure 2:
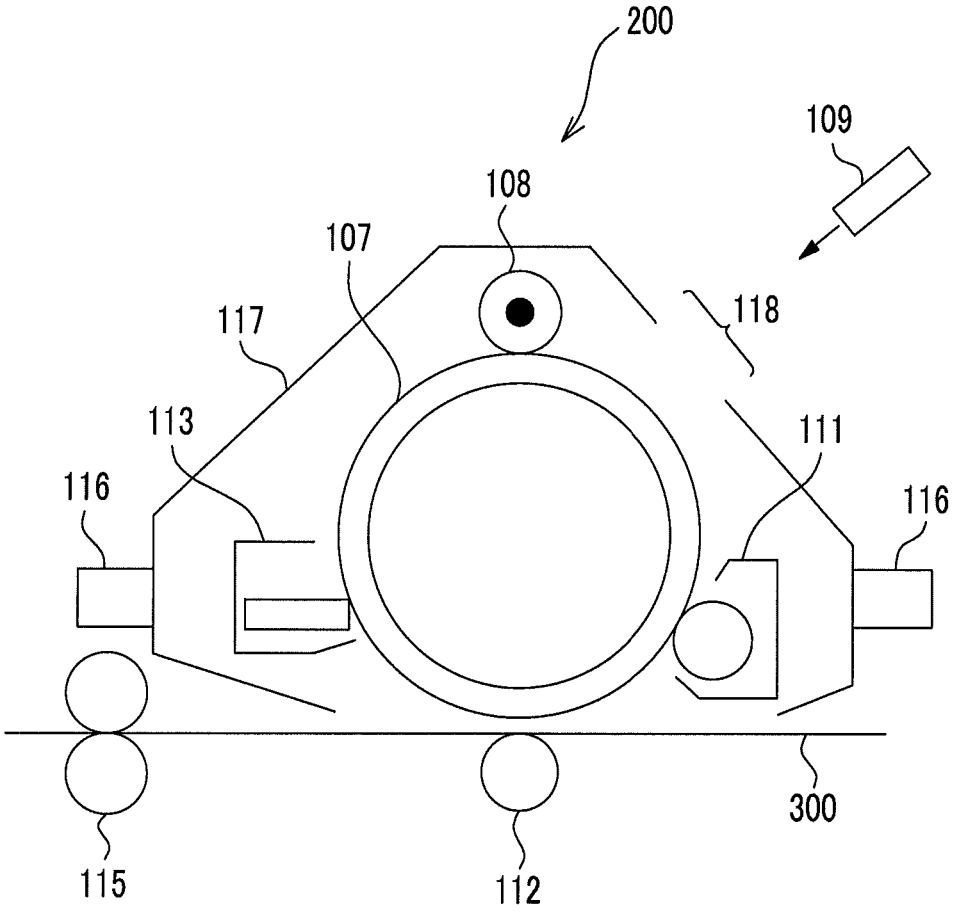
FIG. 2 is a schematic configuration diagram showing an example of a process cartridge according to the present exemplary embodiment.

FIG. 2 is a schematic configuration diagram showing a process cartridge according to the present exemplary embodiment.

A process cartridge 200 shown in FIG. 2 includes, a photoreceptor 107 (an example of the image holding member), and a charging roller 108 (an example of the charging unit), a developing device 111 (an example of the developing unit) and a photoreceptor cleaning device 113 (an example of the cleaning unit) provided in the periphery of the photoreceptor 107, all of which are integrally combined and supported, for example, by a housing 117 provided with a mounting rail 116 and an opening portion 118 for exposure to form a cartridge.

Further, in FIG. 2, 109 denotes an exposure device (an example of the electrostatic charge image forming unit), 112 denotes a transfer device (an example of the transfer unit), 115 denotes a fixing device (an example of the fixing unit), and 300 denotes recording sheet (an example of the recording medium).

Next, a toner cartridge according to the present exemplary embodiment will be described.

The toner cartridge according to the present exemplary embodiment is a toner cartridge which accommodates the toner according to the present exemplary embodiment and is detachable from an image forming apparatus. The toner cartridge accommodates the toner for replenishment to be supplied to the developing unit provided in the image forming apparatus.

Moreover, the image forming apparatus shown in FIG. 1 is an image forming apparatus having a configuration in which the toner cartridges 8Y, 8M, 8C, and 8K are detachably attached, and the developing devices 4Y, 4M, 4C, and 4K are connected to toner cartridges corresponding to the respective developing devices (colors) via a toner supply line not shown. Further, in the case where the toner accommodated in the toner cartridge runs low, the toner cartridge is replaced.

EXAMPLES

Hereafter, the present invention is more specifically described with reference to Examples, but it should be construed that the present invention is not limited to these Examples. In the following description, "parts" and "%" denoting the amounts are each on the basis of weight, unless otherwise indicated.

Preparation of Resin Particle Dispersion (1)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (1-1). Further, the styrene corresponds to the aromatic vinyl monomer and the n-butyl acrylate corresponds to the aliphatic unsaturated alkyl carboxylate ester.

- Styrene (manufactured by Wako Pure Chemical Industries, Ltd.): 8 parts
- n-Butyl acrylate (manufactured by Wako Pure Chemical Industries, Ltd.): 2 parts
- Dodecane thiol (manufactured by Wako Pure Chemical Industries, Ltd.): 0.05 parts
- Anionic surfactant (NEWCOL 271A, manufactured by Nippon Nyukazai Co., Ltd.): 4 parts
- Ion exchange water: 500 parts In addition, the following components are separately put into a container equipped with a stirrer and emulsified while stirring to prepare an emulsion (1-2).

- Styrene (manufactured by Wako Pure Chemical Industries, Ltd.): 470 parts
- n-Butyl acrylate (manufactured by Wako Pure Chemical Industries, Ltd.): 118 parts
- Dodecane thiol (manufactured by Wako Pure Chemical Industries, Ltd.): 2 parts
- Anionic surfactant (NEWCOL 271A, manufactured by Nippon Nyukazai Co., Ltd.): 4 parts
- Ion exchange water: 846 parts The inside of the emulsion (1-1) is sufficiently purged with nitrogen and then heated to a temperature of 75° C. while introducing nitrogen. Fifty parts of a 10% aqueous solution of ammonium persulfate (APS) is added thereto, and the obtained mixture is heated as it is for 20 minutes. Then, the emulsion (1-2) is slowly added dropwise from the monomer dripping port of the reactor of the emulsion (1-1) by a pump over 2 hours, and the reaction is continuously performed at 75° C. Further, after the completion of dropwise addition of the emulsion (1-2), the mixture is kept at 75° C. for 30 minutes, and then 5 parts of a 10% aqueous solution of APS is added to the mixture. Further, after 30 minutes, 5 parts of the 10% aqueous solution is added thereto and the mixture is kept at 75° C. for 1.5 hours and then cooled, thereby obtaining a resin particle dispersion (1) having a volume average particle diameter of 140 nm and a solid content of 30% by weight.

Preparation of Resin Particle Dispersion (2)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (2-1). Further, the 2-ethylhexyl acrylate corresponds to the aliphatic unsaturated alkyl carboxylate ester.

- Styrene (manufactured by Wako Pure Chemical Industries, Ltd.): 8 parts
- 2-Ethylhexyl acrylate (manufactured by Wako Pure Chemical Industries, Ltd.): 2 parts
- Dodecane thiol (manufactured by Wako Pure Chemical Industries, Ltd.): 0.05 parts
- Anionic surfactant (NEWCOL 271A, manufactured by Nippon Nyukazai Co., Ltd.): 4 parts
- Ion exchange water: 500 parts In addition, the following components are separately put into a container equipped with a stirrer and emulsified while stirring to prepare an emulsion (2-2).

- Styrene (manufactured by Wako Pure Chemical Industries, Ltd.): 470 parts
- 2-Ethylhexyl acrylate (manufactured by Wako Pure Chemical Industries, Ltd.): 118 parts
- Dodecane thiol (manufactured by Wako Pure Chemical Industries, Ltd.): 2 parts
- Anionic surfactant (NEWCOL 271A, manufactured by Nippon Nyukazai Co., Ltd.): 4 parts
- Ion exchange water: 851.4 parts The inside of the emulsion (2-1) is sufficiently purged with nitrogen and then heated to a temperature of 75° C. while introducing nitrogen. Fifty parts of a 10% aqueous solution of ammonium persulfate (APS) is added thereto, and the obtained mixture is heated as it is for 20 minutes. Then, the emulsion (2-2) is slowly added dropwise from the monomer dripping port of the reactor of the emulsion (2-1) by a pump over 2 hours, and the reaction is continuously performed at 75° C. Further, after the completion of dropwise addition of the emulsion (2-2), the temperature is changed to 78° C. and kept at the temperature for 1 hour, and 4 parts of a 10% aqueous solution of APS is added to the mixture. Further, after keeping the temperature at 78° C. for 1 hour, followed by cooling, a resin particle dispersion (2)

having a volume average particle diameter of 140 nm and a solid content of 30% by weight is obtained.

Preparation of Resin Particle Dispersion (3)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (3-1).

Styrene (manufactured by Wako Pure Chemical Industries, Ltd.): 9 parts n-Butyl acrylate (manufactured by Wako Pure Chemical Industries, Ltd.): 1 part Dodecane thiol (manufactured by Wako Pure Chemical Industries, Ltd.): 0.05 parts Anionic surfactant (NEWCOL 271A, manufactured by Nippon Nyukazai Co., Ltd.): 4 parts Ion exchange water: 500 parts In addition, the following components are separately put into a container equipped with a stirrer and emulsified while stirring to prepare an emulsion (3-2).

Styrene (manufactured by Wako Pure Chemical Industries, Ltd.): 529 parts n-Butyl acrylate (manufactured by Wako Pure Chemical Industries, Ltd.): 59 parts Dodecane thiol (manufactured by Wako Pure Chemical Industries, Ltd.): 2 parts Anionic surfactant (NEWCOL 271A, manufactured by Nippon Nyukazai Co., Ltd.): 4 parts Ion exchange water: 846 parts In the same manner as in the preparation of the resin particle dispersion (1) except that the emulsion (1-1) and the emulsion (1-2) are changed to the emulsion (3-1) and the emulsion (3-2), respectively, a resin particle dispersion (3) having a volume average particle diameter of 140 nm and a solid content of 30% by weight is obtained.

Preparation of Resin Particle Dispersion (4)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (4-1).

Styrene (manufactured by Wako Pure Chemical Industries, Ltd.): 7 parts n-Butyl acrylate (manufactured by Wako Pure Chemical Industries, Ltd.): 3 parts Dodecane thiol (manufactured by Wako Pure Chemical Industries, Ltd.): 0.05 parts Anionic surfactant (NEWCOL 271A, manufactured by Nippon Nyukazai Co., Ltd.): 4 parts Ion exchange water: 500 parts In addition, the following components are separately put into a container equipped with a stirrer and emulsified while stirring to prepare an emulsion (4-2).

Styrene (manufactured by Wako Pure Chemical Industries, Ltd.): 412 parts n-Butyl acrylate (manufactured by Wako Pure Chemical Industries, Ltd.): 176 parts Dodecane thiol (manufactured by Wako Pure Chemical Industries, Ltd.): 2 parts Anionic surfactant (NEWCOL 271A, manufactured by Nippon Nyukazai Co., Ltd.): 4 parts Ion exchange water: 849.6 parts The inside of the emulsion (4-1) is sufficiently purged with nitrogen and then heated to a temperature of 75° C. while introducing nitrogen. Fifty parts of a 10% aqueous solution of ammonium persulfate (APS) is added thereto, and the obtained mixture is heated as it is for 20 minutes. Then, the emulsion (4-2) is slowly added dropwise from the monomer dripping port of the reactor of the emulsion (4-1) by a pump over 2 hours, and the reaction is continuously performed at 75° C. Further, after the completion of dropwise addition of the emulsion (4-2), the mixture is kept at 75° C. for 30 minutes, and then 6 parts of a 10% aqueous solution of APS is added to the mixture. Further, after keeping the temperature at 75° C. for 3 hours, followed by cooling, a resin particle dispersion (4) having a volume average particle diameter of 140 nm and a solid content of 30% by weight is obtained.

Preparation of Resin Particle Dispersion (5)

A resin particle dispersion (5) is prepared in the following procedure, using the emulsion (1-1) prepared in the same manner as for the emulsion (1) and an emulsion prepared in the same manner as for the emulsion (1-2) except that the amount of the ion exchange water is changed to 826.2 parts (hereinafter referred to as an emulsion (5-2)).

The inside of the emulsion (1-1) is sufficiently purged with nitrogen and then heated to a temperature of 75° C. while introducing nitrogen. Eighty parts of a 10% aqueous solution of ammonium persulfate (APS) is added thereto, and the obtained mixture is heated as it is for 20 minutes. Then, the emulsion (5-2) is slowly added dropwise from the monomer dripping port of the reactor of the emulsion (1-1) by a pump over 2 hours, and the reaction is continuously performed at 75° C. Further, after the completion of dropwise addition of the emulsion (5-2), the temperature is changed to 77° C., and after 30 minutes, 2 parts of a 10% aqueous solution of APS is added to the mixture. Further, after keeping the temperature at 77° C. for 2 hours, followed by cooling, a resin particle dispersion (5) having a volume average particle diameter of 140 nm and a solid content of 30% by weight is obtained.

Preparation of Resin Particle Dispersion (6)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (6-1).

Styrene (manufactured by Wako Pure Chemical Industries, Ltd.): 8 parts n-Butyl acrylate (manufactured by Wako Pure Chemical Industries, Ltd.): 2 parts Dodecane thiol (manufactured by Wako Pure Chemical Industries, Ltd.): 0.05 parts Anionic surfactant (NEWCOL 271A, manufactured by Nippon Nyukazai Co., Ltd.): 4 parts Ion exchange water: 500 parts In addition, the following components are separately put into a container equipped with a stirrer and emulsified while stirring to prepare an emulsion (6-2).

Styrene (manufactured by Wako Pure Chemical Industries, Ltd.): 470 parts n-Butyl acrylate (manufactured by Wako Pure Chemical Industries, Ltd.): 117 parts Dodecane thiol (manufactured by Wako Pure Chemical Industries, Ltd.): 2 parts Anionic surfactant (NEWCOL 271A, manufactured by Nippon Nyukazai Co., Ltd.): 4 parts Ion exchange water: 818.5 parts In addition, the following components are separately put into a container equipped with a stirrer and emulsified while stirring to prepare an emulsion (6-3).

n-Butyl acrylate (manufactured by Wako Pure Chemical Industries, Ltd.): 1 part

Anionic surfactant (NEWCOL 271A, manufactured by Nippon Nyukazai Co., Ltd.): 0.01 parts Ion exchange water: 5 parts The inside of the emulsion (6-1) is sufficiently purged with nitrogen and then heated to a temperature of 75° C. while introducing nitrogen. Eighty parts of a 10% aqueous solution of ammonium persulfate (APS) is added thereto, and the obtained mixture is heated as it is for 20 minutes. Then, the emulsion (6-2) is slowly added dropwise from the monomer dripping port of the reactor of the emulsion (6-1) by a pump over 2 hours, and the reaction is continuously performed at 75° C. Further, after the completion of dropwise addition of the emulsion (6-2), the mixture is kept at 75° C. for 10 minutes, and then an emulsion (6-3) is added dropwise to the mixture. After 30 minutes following the completion of dropwise addition, 5 parts of a 10% aqueous solution of APS is added to the mixture. After keeping the temperature at 75° C. for 3 hours, the mixture is cooled, and, a resin particle dispersion (6) having a volume average particle diameter of 140 nm and a solid content of 30% by weight is obtained.

Preparation of Resin Particle Dispersion (7)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (7-1). Further, the α-methylstyrene corresponds to the aromatic vinyl monomer.

α-Methylstyrene (manufactured by Wako Pure Chemical Industries, Ltd.): 8 parts n-Butyl acrylate (manufactured by Wako Pure Chemical Industries, Ltd.): 2 parts Dodecane thiol (manufactured by Wako Pure Chemical Industries, Ltd.): 0.05 parts Anionic surfactant (NEWCOL 271A, manufactured by Nippon Nyukazai Co., Ltd.): 4 parts Ion exchange water: 500 parts In addition, the following components are separately put into a container equipped with a stirrer and emulsified while stirring to prepare an emulsion (7-2).

α-Methylstyrene (manufactured by Wako Pure Chemical Industries, Ltd.): 470 parts n-Butyl acrylate (manufactured by Wako Pure Chemical Industries, Ltd.): 118 parts Dodecane thiol (manufactured by Wako Pure Chemical Industries, Ltd.): 2 parts Anionic surfactant (NEWCOL 271A, manufactured by Nippon Nyukazai Co., Ltd.): 4 parts Ion exchange water: 846 parts In the same manner as in the preparation of the resin particle dispersion (1) except that the emulsion (1-1) and the emulsion (1-2) are changed to the emulsion (7-1) and the emulsion (7-2), respectively, a resin particle dispersion (7) having a volume average particle diameter of 140 nm and a solid content of 30% by weight is obtained.

Preparation of Resin Particle Dispersion (8)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (8-1). Further, the methyl crotonate corresponds to the aliphatic unsaturated alkyl carboxylate ester.

Styrene (manufactured by Wako Pure Chemical Industries, Ltd.): 8 parts

Methyl crotonate (manufactured by Wako Pure Chemical Industries, Ltd.): 2 parts

Dodecane thiol (manufactured by Wako Pure Chemical Industries, Ltd.): 0.05 parts Anionic surfactant (NEWCOL 271A, manufactured by Nippon Nyukazai Co., Ltd.): 4 parts Ion exchange water: 500 parts In addition, the following components are separately put into a container equipped with a stirrer and emulsified while stirring to prepare an emulsion (8-2).

Styrene (manufactured by Wako Pure Chemical Industries, Ltd.): 470 parts

Methyl crotonate (manufactured by Wako Pure Chemical Industries, Ltd.): 118 parts Dodecane thiol (manufactured by Wako Pure Chemical Industries, Ltd.): 2 parts Anionic surfactant (NEWCOL 271A, manufactured by Nippon Nyukazai Co., Ltd.): 4 parts Ion exchange water: 846 parts In the same manner as in the preparation of the resin particle dispersion (1) except that the emulsion (1-1) and the emulsion (1-2) are changed to the emulsion (8-1) and the emulsion (8-2), respectively, a resin particle dispersion (8) having a volume average particle diameter of 140 nm and a solid content of 30% by weight is obtained.

Preparation of Resin Particle Dispersion (C1)

A resin particle dispersion (C1) is prepared in the following procedure, using the emulsion (1-1) prepared in the same manner as for the emulsion (1) and an emulsion prepared in the same manner as for the emulsion (1-2) except that the amount of the ion exchange water is changed to 855 parts (hereinafter referred to as an emulsion (C1-2)).

The inside of the emulsion (1-1) is sufficiently purged with nitrogen and then heated to a temperature of 75° C. while introducing nitrogen. Fifty parts of a 10% aqueous solution of ammonium persulfate (APS) is added thereto, and the obtained mixture is heated as it is for 20 minutes. Then, the emulsion (C1-2) is slowly added dropwise from the monomer dripping port of the reactor of the emulsion (1-1) by a pump over 2 hours, and the reaction is continuously performed at 75° C. Further, after the completion of dropwise addition of the emulsion (C1-2), the mixture is kept at 75° C. for 2.5 hours and then cooled, thereby obtaining a resin particle dispersion (C1) having a volume average particle diameter of 140 nm and a solid content of 30% by weight.

Preparation of Resin Particle Dispersion (C2)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (C2-1).

Styrene (manufactured by Wako Pure Chemical Industries, Ltd.): 9 parts n-Butyl acrylate (manufactured by Wako Pure Chemical Industries, Ltd.): 1 part Dodecane thiol (manufactured by Wako Pure Chemical Industries, Ltd.): 0.05 parts Anionic surfactant (NEWCOL 271A, manufactured by Nippon Nyukazai Co., Ltd.): 4 parts Ion exchange water: 500 parts In addition, the following components are separately put into a container equipped with a stirrer and emulsified while stirring to prepare an emulsion (C2-2).

Styrene (manufactured by Wako Pure Chemical Industries, Ltd.): 536 parts n-Butyl acrylate (manufactured by Wako Pure Chemical Industries, Ltd.): 52 parts Dodecane thiol (manufactured by Wako Pure Chemical Industries, Ltd.): 2 parts Anionic surfactant (NEWCOL 271A, manufactured by Nippon Nyukazai Co., Ltd.): 4 parts Ion exchange water: 846 parts In the same manner as in the preparation of the resin particle dispersion (3) except that the emulsion (3-1) and the emulsion (3-2) are changed to the emulsion (C2-1) and the emulsion (C2-2), respectively, a resin particle dispersion (C2) having a volume average particle diameter of 140 nm and a solid content of 30% by weight is obtained.

Preparation of Resin Particle Dispersion (C3)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (C3-1).

Styrene (manufactured by Wako Pure Chemical Industries, Ltd.): 7 parts n-Butyl acrylate (manufactured by Wako Pure Chemical Industries, Ltd.): 3 parts Dodecane thiol (manufactured by Wako Pure Chemical Industries, Ltd.): 0.05 parts Anionic surfactant (NEWCOL 271A, manufactured by Nippon Nyukazai Co., Ltd.): 4 parts Ion exchange water: 500 parts In addition, the following components are separately put into a container equipped with a stirrer and emulsified while stirring to prepare an emulsion (C3-2).

Styrene (manufactured by Wako Pure Chemical Industries, Ltd.): 405 parts n-Butyl acrylate (manufactured by Wako Pure Chemical Industries, Ltd.): 183 parts Dodecane thiol (manufactured by Wako Pure Chemical Industries, Ltd.): 2 parts Anionic surfactant (NEWCOL 271A, manufactured by Nippon Nyukazai Co., Ltd.): 4 parts Ion exchange water: 846 parts In the same manner as in the preparation of the resin particle dispersion (4) except that the emulsion (4-1) and the emulsion (4-2) are changed to the emulsion (C3-1) and the emulsion (C3-2), respectively, a resin particle dispersion (C3) having a volume average particle diameter of 140 nm and a solid content of 30% by weight is obtained.

Preparation of Resin Particle Dispersion (C4)

The following components are put into a reactor equipped with a reflux condenser, a stirrer, a nitrogen gas introduction tube, and a monomer dripping port, and the mixture is thoroughly stirred at room temperature (25° C.), thereby preparing an emulsion (C4-2).

Styrene (manufactured by Wako Pure Chemical Industries, Ltd.): 470 parts n-Butyl acrylate (manufactured by Wako Pure Chemical Industries, Ltd.): 116 parts Dodecane thiol (manufactured by Wako Pure Chemical Industries, Ltd.): 2 parts Anionic surfactant (NEWCOL 271A, manufactured by Nippon Nyukazai Co., Ltd.): 4 parts Ion exchange water: 813.5 parts In addition, the following components are separately put into a container equipped with a stirrer and emulsified while stirring to prepare an emulsion (C4-3).

n-Butyl acrylate (manufactured by Wako Pure Chemical Industries, Ltd.): 2 parts

Anionic surfactant (NEWCOL 271A, manufactured by Nippon Nyukazai Co., Ltd.): 0.02 parts Ion exchange water: 10 parts In the same manner as in the preparation of the resin particle dispersion (6) except that the emulsion (6-2) and the emulsion (6-3) are changed to the emulsion (C4-2) and the emulsion (C4-3), respectively, a resin particle dispersion (C4) having a volume average particle diameter of 140 nm and a solid content of 30% by weight is obtained.

Preparation of Colored Particle Dispersion

Carbon black (manufactured by Mitsubishi Chemical Corporation, product name #25B): 20 parts Anionic surfactant (NEOGEN SC, manufactured by Dai-Ichi Kogyo Seiyaku Co., Ltd.): 2 parts Ion exchange water: 80 parts The aforementioned components are mixed and dispersed for 1 hour by a high pressure impact type dispersing machine, ULTIMIZER (HJP30006, manufactured by Sugino Machine, Ltd.), thereby obtaining a colorant particle dispersion having a volume average particle diameter of 180 nm and a solid content of 20% by weight.

Preparation of Release Agent Particle Dispersion

Paraffin wax (manufactured by Toyo ADL Corporation, product name Polywax 500): 20 parts Anionic surfactant (NEOGEN SC, manufactured by Dai-Ichi Kogyo Seiyaku Co., Ltd.): 2 parts Ion exchange water: 80 parts The aforementioned components are mixed, heated to 100° C., sufficiently dispersed by ULTRA TURRAX T50 manufactured by IKA-Werke GmbH & CO. KG), and then dispersion-treated by a pressure ejection type Gaulin homogenizer, thereby obtaining a release agent particle dispersion having a volume average particle diameter of 200 nm and a solid content of 20% by weight.

Example 1

Preparation of Toner Particles (1)

Resin fine particles dispersion (1): 250 parts

Colorant dispersion: 25 parts

Release agent particle dispersion: 25 parts

Ion exchange water: 300 parts

The aforementioned components are sufficiently mixed and dispersed in a round stainless steel flask by ULTRA TURRAX (T50, manufactured by IKA). Then, to the obtained dispersion is added 0.4 parts by weight of polyaluminum chloride, and the dispersion operation is continuously performed by ULTRA TURRAX.

Thereafter, the flask is heated to 50° C. while stirring in an oil bath for heating. After the mixture is kept at 50° C. for 60 minutes, 150 parts of the resin particle dispersion (1) is further added thereto. Then, the pH of the system is adjusted to 5.5 with a 1 N aqueous sodium hydroxide solution, and then the stainless steel flask is closed. The mixture is heated to 95° C. while continuously stirring using a magnetic seal, and is kept for 3 hours.

After the completion of the reaction, the mixture is cooled, filtered, and washed with ion exchange water, and subjected to solid-liquid separation by Nutsche type suction-filtration. The separated solid is further re-dispersed with 3 liters of ion exchange water at 40° C., and stirred and washed at 300 rpm for 15 minutes. Further, this operation is repeated five times and solid-liquid separation is performed by Nutsche type suction-filtration using filter paper of No. 5A. Then, the resultant is continuously dried in vacuum for 12 hours to obtain toner particles (1).

In the obtained toner particles (1), MW2/(MW1+MW2) in the expression (1) and mw1, mw2, and mw2/(mw1+mw2) in the expression (2) are determined. The results are shown in Table 1.

Preparation of Toner

To 100 parts by weight of the toner particles (1) are added 1.5 parts by weight of hydrophobic silica (manufactured by Nippon Aerosil Co., Ltd., RY50), followed by mixing at a peripheral speed of 30 m/sec for 3 minutes by a Henschel mixer, to obtain a toner (1).

Example 2

In the same manner as in Example 1 except that the resin particle dispersion (1) is changed to the resin particle dispersion (2), toner particles (2) and a toner (2) are prepared.

In the obtained toner particles (2), MW2/(MW1+MW2) in the expression (1) and mw1, mw2, and mw2/(mw1+mw2) in the expression (2) are determined. The results are shown in Table 1.

Example 3

In the same manner as in Example 1 except that the resin particle dispersion (1) is changed to the resin particle dispersion (3), toner particles (3) and a toner (3) are prepared.

In the obtained toner particles (3), MW2/(MW1+MW2) in the expression (1) and mw1, mw2, and mw2/(mw1+mw2) in the expression (2) are determined. The results are shown in Table 1.

Example 4

In the same manner as in Example 1 except that the resin particle dispersion (1) is changed to the resin particle dispersion (4), toner particles (4) and a toner (4) are prepared.

In the obtained toner particles (4), MW2/(MW1+MW2) in the expression (1) and mw1, mw2, and mw2/(mw1+mw2) in the expression (2) are determined. The results are shown in Table 1.

Example 5

In the same manner as in Example 1 except that the resin particle dispersion (1) is changed to the resin particle dispersion (5), toner particles (5) and a toner (5) are prepared.

In the obtained toner particles (5), MW2/(MW1+MW2) in the expression (1) and mw1, mw2, and mw2/(mw1+mw2) in the expression (2) are determined. The results are shown in Table 1.

Example 6

In the same manner as in Example 1 except that the resin particle dispersion (1) is changed to the resin particle dispersion (6), toner particles (6) and a toner (6) are prepared.

In the obtained toner particles (6), MW2/(MW1+MW2) in the expression (1) and mw1, mw2, and mw2/(mw1+mw2) in the expression (2) are determined. The results are shown in Table 1.

Example 7

In the same manner as in Example 1 except that the resin particle dispersion (1) is changed to the resin particle dispersion (7), toner particles (7) and a toner (7) are prepared.

In the obtained toner particles (7), MW2/(MW1+MW2) in the expression (1) and mw1, mw2, and mw2/(mw1+mw2) in the expression (2) are determined. The results are shown in Table 1.

Example 8

In the same manner as in Example 1 except that the resin particle dispersion (1) is changed to the resin particle dispersion (8), toner particles (8) and a toner (8) are prepared.

In the obtained toner particles (8), MW2/(MW1+MW2) in the expression (1) and mw1, mw2, and mw2/(mw1+mw2) in the expression (2) are determined. The results are shown in Table 1.

Comparative Example 1

In the same manner as in Example 1 except that the resin particle dispersion (1) is changed to the resin particle dispersion (C1), toner particles (C1) and a toner (C1) are prepared.

In the obtained toner particles (C1), MW2/(MW1+MW2) in the expression (1) and mw1, mw2, and mw2/(mw1+mw2) in the expression (2) are determined. The results are shown in Table 2.

Comparative Example 2

In the same manner as in Example 1 except that the resin particle dispersion (1) is changed to the resin particle dispersion (C2), toner particles (C2) and a toner (C2) are prepared.

In the obtained toner particles (C2), MW2/(MW1+MW2) in the expression (1) and mw1, mw2, and mw2/(mw1+mw2) in the expression (2) are determined. The results are shown in Table 2.

Comparative Example 3

In the same manner as in Example 1 except that the resin particle dispersion (1) is changed to the resin particle dispersion (C3), toner particles (C3) and a toner (C3) are prepared.

In the obtained toner particles (C3), MW2/(MW1+MW2) in the expression (1) and mw1, mw2, and mw2/(mw1+mw2) in the expression (2) are determined. The results are shown in Table 2.

Comparative Example 4

In the same manner as in Example 1 except that the resin particle dispersion (1) is changed to the resin particle dispersion (C4), toner particles (C4) and a toner (C4) are prepared.

In the obtained toner particles (C4), MW2/(MW1+MW2) in the expression (1) and mw1, mw2, and mw2/(mw1+mw2) in the expression (2) are determined. The results are shown in Table 2.

EVALUATION

After preparing a developer using the toner obtained in each of Examples and Comparative Examples, paper staining and image deletion are evaluated. The results are shown in Tables 1 and 2.

Further, the developer is prepared in the following manner.

Seven parts of the toner obtained in each of Examples and Comparative Examples and 93 parts of a resin-coated carrier (manganese-magnesium-strontium ferrite coated with a silicone resin) are mixed by a V-blender to prepare each of the developers.

Evaluation of Paper Staining and Image Deletion

The paper staining and the image deletion are evaluated in the following manner.

The developer is put into a modified machine of D125 Printer, manufactured by Fuji Xerox Co., Ltd., and an image having an image density of 40% is continuously output on 3,000 sheets of A4 paper at a speed of 125 sheets/min, using this modified machine, under an environment close to a freezing point of a temperature of 4° C. and a humidity of 8% RH. Then, the letter image having an image density of 2% is output on 10 sheets of A4 paper. For the tenth sheet on which the letter image is output, the paper staining and the image deletion are visually evaluated according to the following criteria.

G1: The paper staining or the image deletion is not perceived at all and a very good image is obtained.

G2: The paper staining or the image deletion is slightly perceived, but is at a level sufficiently acceptable, and a good image is obtained.

G3: The paper staining or the image deletion is slightly perceived, but is at an acceptable level.

G4: The paper staining or the image deletion is visually clearly perceived.

Examples show reduction in the paper staining and the image deletion, as compared with Comparative Examples. Therefore, in the case where the toners of the Examples are applied, it may be seen that the mixing property of the toner in the developer is good even when a high-density image is continuously output at a high speed under an environment of a low temperature, a temperature below zero or close to a freezing point, and a low humidity.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, comprising toner particles including a binder resin that contains a copolymer formed by copolymerizing at least an aromatic vinyl monomer and an aliphatic unsaturated alkyl carboxylate ester, wherein a weight ratio of component M1 of the aromatic vinyl monomer and component M2 of the aliphatic unsaturated alkyl carboxylate ester in the copolymer

TABLE 1

| | | | Example 1 | Example 2 | Example 3 | Example 4 | Example 5 | Example 6 | Example 7 | Example 8 |
|---|---|---|---|---|---|---|---|---|---|---|
| Toner particles | | | (1) | (2) | (3) | (4) | (5) | (6) | (7) | (8) |
| Binder resin | Resin particle dispersion | | (1) | (2) | (3) | (4) | (5) | (6) | (7) | (8) |
| | Copolymer | Aromatic vinyl monomer | Styrene | Styrene | Styrene | Styrene | Styrene | Styrene | α-Methylstyrene | Styrene |
| | | Aliphatic unsaturated alkyl carboxylate ester | n-Butyl acrylate | 2-Ethylhexyl acrylate | n-Butyl acrylate | n-Butyl acrylate | n-Butyl acrylate | n-Butyl acrylate | n-Butyl acrylate | Methyl crotonate |
| | | MW2/(MW1 + MW2) | 0.20 | 0.20 | 0.10 | 0.30 | 0.20 | 0.20 | 0.20 | 0.20 |
| Volatile components of toner particles | | mw1 | 9 ppm | 10 ppm | 13 ppm | 19 ppm | 21 ppm | 4 ppm | 7 ppm | 12 ppm |
| | | mw2 | 92 ppm | 75 ppm | 64 ppm | 252 ppm | 49 ppm | 196 ppm | 81 ppm | 108 ppm |
| | | mw2/(mw1 + mw2) | 0.91 | 0.88 | 0.83 | 0.93 | 0.70 | 0.98 | 0.92 | 0.90 |
| Evaluation of paper staining and image deletion | | | G1 | G1 | G3 | G3 | G3 | G3 | G2 | G2 |

TABLE 2

| | | | Comparative Example 1 | Comparative Example 2 | Comparative Example 3 | Comparative Example 4 |
|---|---|---|---|---|---|---|
| Toner particles | | | (C1) | (C2) | (C3) | (C4) |
| Binder resin | Resin particle dispersion | | (C1) | (C2) | (C3) | (C4) |
| | Copolymer | Aromatic vinyl monomer | Styrene | Styrene | Styrene | Styrene |
| | | Aliphatic unsaturated alkyl carboxylate ester | n-Butyl acrylate | n-Butyl acrylate | n-Butyl acrylate | n-Butyl acrylate |
| | | MW2/(MW1 + MW2) | 0.20 | 0.09 | 0.31 | 0.20 |
| Volatile components of toner particles | | mw1 | 70 ppm | 15 ppm | 17 ppm | 5 ppm |
| | | mw2 | 110 ppm | 57 ppm | 269 ppm | 495 ppm |
| | | mw2/(mw1 + mw2) | 0.61 | 0.79 | 0.94 | 0.99 |
| Evaluation of paper staining and image deletion | | | G4 | G4 | G4 | G4 |

The evaluation results are shown in Tables 1 and 2. From the results in Tables 1 and 2, it may be seen that in the evaluation of the paper staining and the image deletion, the satisfies the following expression (1), and a weight ratio of volatile component m1 of the aromatic vinyl monomer and volatile component m2 of the aliphatic unsaturated alkyl carboxylate ester, as measured by a headspace method, satisfies the following expression (2):

$$0.10 \leq MW2/(MW1+MW2) \leq 0.30 \quad \text{Expression (1)}$$

$$0.70 \leq mw2/(mw1+mw2) \leq 0.98 \quad \text{Expression (2)}$$

wherein in the expressions (1) and (2), MW1 represents the weight of M1, MW2 represents the weight of M2, mw1 represents the weight of m1, and mw2 represents the weight of m2.

2. The electrostatic charge image developing toner according to claim 1, wherein the aromatic vinyl monomers is styrene.

3. The electrostatic charge image developing toner according to claim 1, wherein the aliphatic unsaturated alkyl carboxylate ester is an alkyl (meth)acrylate ester.

4. The electrostatic charge image developing toner according to claim 1, wherein a glass transition temperature (Tg) of the copolymer is from 40° C. to 80° C.

5. The electrostatic charge image developing toner according to claim 1, wherein a weight-average molecular weight (Mw) of the copolymer is from 5000 to 150000.

6. The electrostatic charge image developing toner according to claim 1, wherein a number-average molecular weight (Mn) of the copolymer is from 2000 to 50000.

7. The electrostatic charge image developing toner according to claim 1, wherein a molecular weight distribution Mw/Mn of the copolymer is from 1.2 to 20.

8. The electrostatic charge image developing toner according to claim 1, wherein a content of the copolymer is from 15% by weight to 100% by weight with respect to the entirety of the binder resin.

9. The electrostatic charge image developing toner according to claim 1, wherein a content of the binder resin is from 40% by weight to 98% by weight with respect to the entirety of the toner particles.

10. The electrostatic charge image developing toner according to claim 1, further comprising a release agent having a melting point of 50° C. to 150° C.

11. The electrostatic charge image developing toner according to claim 10, wherein a content of the release agent is from 1% by weight to 20% by weight with respect to the entirety of the toner particles.

12. The electrostatic charge image developing toner according to claim 1, wherein the toner particles have a core-shell structure.

13. The electrostatic charge image developing toner according to claim 1, wherein the toner particles have a shape factor SF1 of from 110 to 150.

14. The electrostatic charge image developing toner according to claim 1, wherein hydrophobization-treated inorganic particles are included on a surface of the toner particles.

15. The electrostatic charge image developing toner according to claim 14, wherein the inorganic particles are silica.

16. The electrostatic charge image developing toner according to claim 14, wherein a content of the inorganic particles is from 0.01% by weight to 5% by weight with respect to the toner particles.

17. An electrostatic charge image developer comprising the electrostatic charge image developing toner according to claim 1.

18. The electrostatic charge image developer according to claim 17, further comprising a coated carrier, in which a surface of a core including magnetic particles is coated with a coating resin.

19. The electrostatic charge image developer according to claim 18, wherein the coating resin is a silicone resin.

20. A toner cartridge that accommodates the electrostatic charge image developing toner according to claim 1, and is detachable from an image forming apparatus.

* * * * *